US011545796B2

(12) United States Patent
Watkins et al.

(10) Patent No.: US 11,545,796 B2
(45) Date of Patent: Jan. 3, 2023

(54) COAXIAL CABLE CONNECTORS HAVING PORT GROUNDING

(71) Applicant: PPC BROADBAND, INC., East Syracuse, NY (US)

(72) Inventors: Harold Watkins, Chittenango, NY (US); Richard Maroney, Camillus, NY (US); Amos McKinnon, Liverpool, NY (US); Noah P. Montena, Syracuse, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 16/395,220

(22) Filed: Apr. 25, 2019

(65) Prior Publication Data

US 2019/0334296 A1 Oct. 31, 2019

Related U.S. Application Data

(60) Provisional application No. 62/662,535, filed on Apr. 25, 2018.

(51) Int. Cl.
*H01R 13/622* (2006.01)
*H01R 24/40* (2011.01)
*H01R 103/00* (2006.01)

(52) U.S. Cl.
CPC ..... *H01R 24/40* (2013.01); *H01R 13/622* (2013.01); *H01R 2103/00* (2013.01)

(58) Field of Classification Search
CPC . H01R 4/28; H01R 4/30; H01R 4/304; H01R 4/38; H01R 4/44; H01R 4/48;
(Continued)

(56) References Cited

U.S. PATENT DOCUMENTS 3,526,871 A * 9/1970 Hobart ..... H01R 9/05 439/584
4,017,139 A * 4/1977 Nelson ..... F16L 37/133 439/352

(Continued)

FOREIGN PATENT DOCUMENTS

GB 2504734 A 2/2014

OTHER PUBLICATIONS

Aug. 8, 2019 International Search Report issued in PCT/US19/29240.

(Continued)

*Primary Examiner* — Renee S Luebke
*Assistant Examiner* — Milagros Jeancharles
(74) *Attorney, Agent, or Firm* — MH2 Technology Law Group LLP

(57) ABSTRACT

A coaxial cable connector includes a body configured to engage a coaxial cable having a conductive electrical grounding property, a post configured to engage the body and the coaxial cable when the connector is installed on the coaxial cable, a nut configured to engage an interface port at a retention force, and a conductive insert received inside the nut. The conductive insert is configured to increase the retention force between the nut and the interface port so as to provide an electrical ground connection between the interface port and the nut when the nut is in a loosely tightened position on the interface port, and/or the conductive insert is configured to make the electrical ground connection with the interface port before a center conductor of the coaxial cable makes an electrical connection with an internal contact of the interface port when the nut is coupled with the interface port.

27 Claims, 11 Drawing Sheets

(58) Field of Classification Search
CPC ..... H01R 9/05; H01R 9/0524; H01R 9/0512; H01R 9/0521; H01R 13/11; H01R 13/187; H01R 13/193; H01R 13/622; H01R 13/502; H01R 13/6592; H01R 13/648; H01R 13/652; H01R 13/6583; H01R 2103/00; H01R 24/38; H01R 24/40
See application file for complete search history.

(56) References Cited

U.S. PATENT DOCUMENTS 4,426,127 A * 1/1984 Kubota ..... H01R 24/40 439/607.17
4,973,265 A * 11/1990 Heeren ..... H01R 9/0521 439/584
5,154,636 A * 10/1992 Vaccaro ..... H01R 24/564 439/578
5,195,906 A * 3/1993 Szegda ..... H01R 9/0521 439/255
7,587,244 B2 * 9/2009 Olbertz ..... A61N 1/3752 607/37
8,062,063 B2 * 11/2011 Malloy ..... H01R 13/187 439/578
8,152,551 B2 * 4/2012 Zraik ..... H01R 24/40 439/322
8,915,751 B2 12/2014 Wood
8,915,753 B2 * 12/2014 Holland ..... H01R 9/05 439/578
9,166,348 B2 * 10/2015 Burris ..... H01R 13/622
10,622,749 B2 * 4/2020 Watkins ..... H01R 13/622
10,819,047 B2 * 10/2020 Watkins ..... H01R 13/5205
10,910,751 B2 * 2/2021 Maroney ..... H01R 13/622
11,005,212 B2 * 5/2021 Watkins ..... H01R 13/622
11,024,989 B2 * 6/2021 Watkins ..... H01R 13/5221
2012/0171894 A1 7/2012 Malloy et al.
2013/0149896 A1 6/2013 Holland et al.
2013/0323967 A1 12/2013 Wood
2014/0342594 A1 * 11/2014 Montena ..... H01R 9/0524 439/359
2015/0111429 A1 * 4/2015 Hoyak ..... H01R 9/05 439/607.17
2017/0149152 A1 * 5/2017 Watkins ..... H01R 24/38
2018/0054017 A1 2/2018 Watkins et al.
2019/0252836 A1 * 8/2019 Watkins ..... H01R 13/622
2019/0288410 A1 * 9/2019 Maroney ..... H01R 13/6583
2020/0274264 A1 * 8/2020 Watkins ..... H01R 13/521
2020/0358323 A1 * 11/2020 Saitoh ..... H02K 1/16
2020/0381877 A1 * 12/2020 Watkins ..... H01R 13/622

OTHER PUBLICATIONS

International Preliminary Report on Patentability dated Oct. 27, 2020 in corresponding International Application No. PCT/US2019/029240, 6 pages.
Extended European Search Report dated Dec. 15, 2021 in corresponding European Application No. 19794005.9, 9 pages.

* cited by examiner

COAXIAL CABLE CONNECTORS HAVING PORT GROUNDING

CROSS-REFERENCE TO RELATED APPLICATION

This nonprovisional application claims the benefit of U.S. Provisional Application No. 62/662,535, filed Apr. 25, 2018, the disclosure of which is incorporated herein by reference in its entirety.

BACKGROUND

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference.

Connectors for coaxial cables are typically connected onto complementary interface ports to electrically integrate coaxial cables to various electronic devices and cable communication equipment. Connection is often made through rotatable operation of an internally threaded nut of the connector about a corresponding externally threaded interface port. Fully tightening the threaded connection of the coaxial cable connector to the interface port helps to ensure a ground connection between the connector and the corresponding interface port.

However, often connectors are not fully and/or properly tightened or otherwise installed to the interface port and proper electrical mating of the connector with the interface port does not occur. Moreover, typical component elements and structures of common connectors may permit loss of ground and discontinuity of the electromagnetic shielding that is intended to be extended from the cable, through the connector, and to the corresponding coaxial cable interface port. In particular, in order to allow the threaded nut of a connector to rotate relative to the threaded interface port, sufficient clearance must exist between the matching male and female threads. When the connector is left loose on the interface port (i.e., not fully and/or properly tightened), gaps may still exist between surfaces of the mating male and female threads, thus creating a break in the electrical connection of ground.

Lack of continuous port grounding in a conventional threaded connector, for example, when the conventional threaded connector is loosely coupled with an interface port (i.e., when in a loose state relative to the interface port), introduces noise and ultimately performance degradation in conventional RF systems. Furthermore, lack of ground contact prior to the center conductor contacting the interface port may also introduce an undesirable "burst" of noise upon insertion of the center conductor into the interface port. This noise may be sent back to the headend, causing packet errors.

Accordingly, there is a need to overcome, or otherwise lessen the effects of, the disadvantages and shortcomings described above. Hence a need exists for a coaxial cable connector having improved grounding between the coaxial cable, the connector, and the coaxial cable connector interface port. In some aspects, it may be desirable to provide a connector having a grounding member that makes contact with the interface port before the center connector of the coaxial cable makes contact with the interface port.

SUMMARY

According to various aspects of the disclosure, a coaxial cable connector includes a body configured to engage a coaxial cable having a conductive electrical grounding property, a post configured to engage the body and the coaxial cable when the connector is installed on the coaxial cable, a nut configured to engage an interface port at a retention force, and a conductive insert received inside the nut. The conductive insert is configured to increase the retention force between the nut and the interface port so as to provide an electrical ground connection between the interface port and the nut when the nut is in a loosely tightened position on the interface port, and the conductive insert is configured to make the electrical ground connection with the interface port before a center conductor of the coaxial cable makes an electrical connection with an internal contact of the interface port when the nut is coupled with the interface port.

In some embodiments, a coaxial cable connector includes a body configured to engage a coaxial cable having a conductive electrical grounding property, a post configured to engage the body and the coaxial cable when the connector is installed on the coaxial cable, a nut configured to engage an interface port at a retention force, and a conductive insert received inside the nut. The conductive insert is configured to increase the retention force between the nut and the interface port so as to provide an electrical ground connection between the interface port and the nut when the nut is in a loosely tightened position on the interface port According to some embodiments, a coaxial cable connector includes a body configured to engage a coaxial cable having a conductive electrical grounding property, a post configured to engage the body and the coaxial cable when the connector is installed on the coaxial cable, a nut configured to engage an interface port at a retention force, and a conductive insert received inside the nut. The conductive insert is configured to make the electrical ground connection with the interface port before a center conductor of the coaxial cable makes an electrical connection with an internal contact of the interface port when the nut is coupled with the interface port.

In an aspect of one or more of the foregoing embodiments, the nut includes internal threads configured to engage the interface port at the retention force.

In an aspect of one or more of the foregoing embodiments, the conduct insert includes at least one resilient finger configured to define an inner diameter smaller than an outer diameter of the interface port.

In an aspect of one or more of the foregoing embodiments, the at least one resilient finger is configured to taper from a first diameter at a rearward end portion to a second smaller diameter at a middle portion.

In an aspect of one or more of the foregoing embodiments, the at least one finger is configured to flare radially outward from the middle portion to a front end portion.

In an aspect of one or more of the foregoing embodiments, the at least one finger is configured to define a bend point at the middle portion, the bend point being configured to further increase the retention force between the nut and the interface port.

In an aspect of one or more of the foregoing embodiments, the at least one resilient finger is configured to extend beyond a forward end of the nut and engage the interface port.

In an aspect of one or more of the foregoing embodiments, at least one of the nut and the conduct insert includes an engagement feature configured to couple the grounding member to the nut.

In an aspect of one or more of the foregoing embodiments, the nut includes an annular recess configured to receive the conductive insert.

BRIEF DESCRIPTION OF THE DRAWINGS

Features and advantages of the present disclosure are described in, and will be apparent from, the following Brief Description of the Drawings and Detailed Description.

DETAILED DESCRIPTION OF EMBODIMENTS

The accompanying figures illustrate various exemplary embodiments of coaxial cable connectors that provide improved grounding between the coaxial cable, the connector, and the coaxial cable connector interface port. Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a," "an," and "the" include plural referents, unless the context clearly dictates otherwise.

Figure 1:
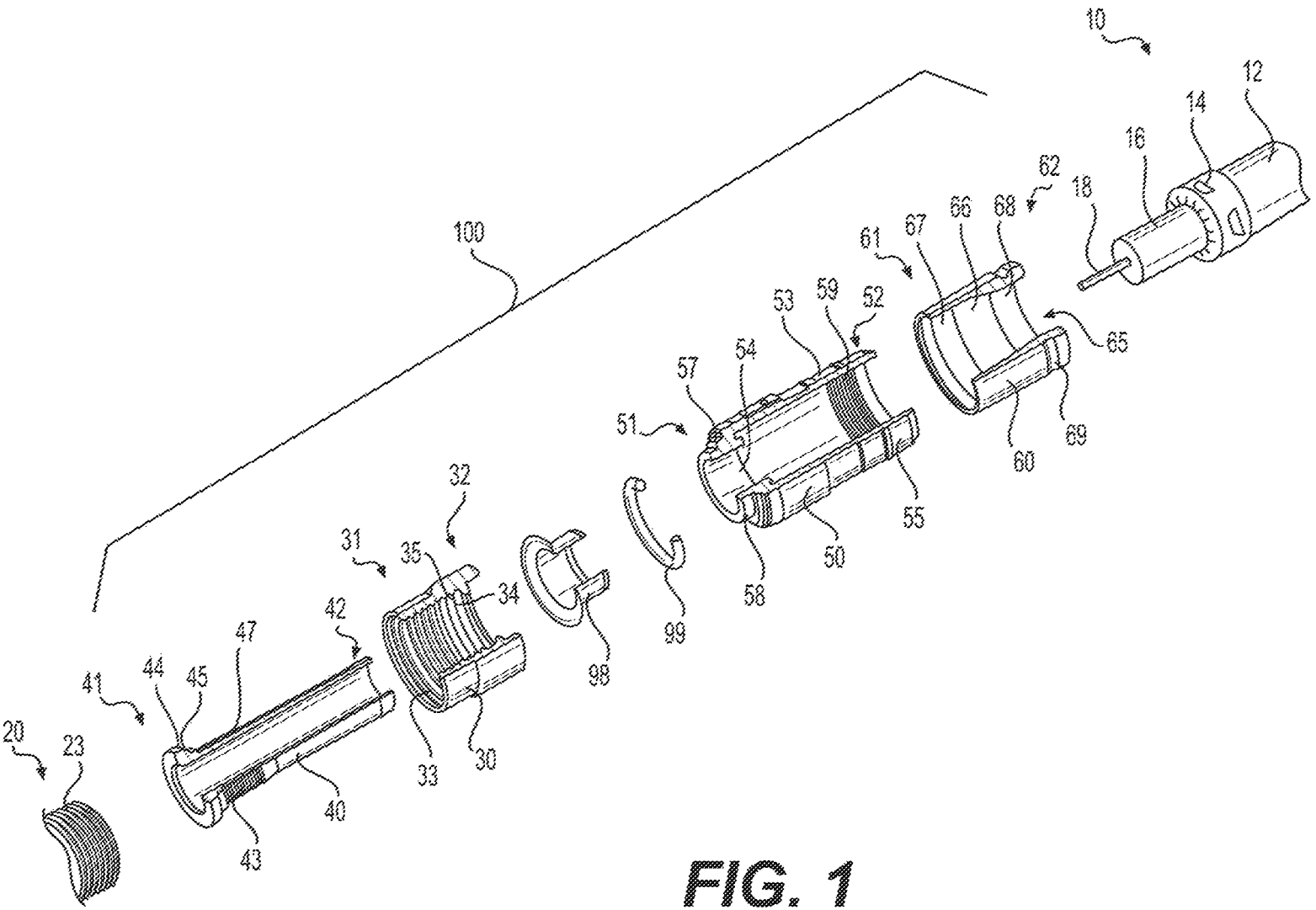
FIG. 1 (PRIOR ART)
FIG. 1 is an exploded perspective cut-away view of a conventional coaxial cable connector.

Referring to the drawings, FIG. 1 depicts a conventional coaxial cable connector 100. The coaxial cable connector 100 may be operably affixed, or otherwise functionally attached, to a coaxial cable 10 having a protective outer jacket 12, a conductive grounding shield 14, an interior dielectric 16 and a center conductor 18. The coaxial cable 10 may be prepared as embodied in FIG. 1 by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection, such as cuprous braided material, aluminum foils, thin metallic elements, or other like structures. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation, such as plastic foam material, paper materials, rubber-like polymers, or other functional insulating materials. It should be noted that the various materials of which all the various components of the coaxial cable 10 are comprised should have some degree of elasticity allowing the cable 10 to flex or bend in accordance with traditional broadband communication standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring further to FIG. 1, the connector 100 may be configured to be coupled with a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's operable electrical interface with the connector 100. However, the receptacle of the port 20 should be formed of a conductive material, such as a metal, like brass, copper, or aluminum. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

Referring still further to FIG. 1, the conventional coaxial cable connector 100 may include a coupler, for example, threaded nut 30, a post 40, a connector body 50, a fastener member 60, a grounding member 98 formed of conductive material, and a connector body sealing member 99, such as, for example, a body O-ring configured to fit around a portion of the connector body 50. The nut 30 at the front end of the post 40 serves to attach the connector 100 to an interface port.

The threaded nut 30 of the coaxial cable connector 100 has a first forward end 31 and opposing second rearward end 32. The threaded nut 30 may comprise internal threading 33 extending axially from the edge of first forward end 31 a distance sufficient to provide operably effective threadable contact with the external threads 23 of the standard coaxial cable interface port 20. The threaded nut 30 includes an internal lip 34, such as an annular protrusion, located proximate the second rearward end 32 of the nut. The internal lip 34 includes a surface 35 facing the first forward end 31 of the nut 30. The forward facing surface 35 of the lip 34 may be a tapered surface or side facing the first forward end 31 of the nut 30. The structural configuration of the nut 30 may vary according to differing connector design parameters to accommodate different functionality of a coaxial cable connector 100. For instance, the first forward end 31 of the nut 30 may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, at the first forward end 31 of a nut 30, when mated with the interface port 20. Moreover, the second rearward end 32 of the nut 30 may extend a significant axial distance to reside radially extent, or otherwise partially surround, a portion of the connector body 50, although the extended portion of the nut 30 need not contact the connector body 50. The threaded nut 30 may be formed of conductive materials, such as copper, brass, aluminum, or other metals or metal alloys, facilitating grounding through the nut 30. Accordingly, the nut 30 may be configured to extend an electromagnetic buffer by electrically contacting conductive surfaces of an interface port 20 when a connector 100 is advanced onto the port 20. In addition, the threaded nut 30 may be formed of both conductive and non-conductive materials. For example, the external surface of the nut 30 may be formed of a polymer, while the remainder of the nut 30 may be comprised of a metal or other conductive material. The threaded nut 30 may be formed of metals or polymers or other materials that would facilitate a rigidly formed nut body. Manufacture of the threaded nut 30 may include casting, extruding, cutting, knurling, turning, tapping, drilling, injection molding, blow molding, combinations thereof, or other fabrication methods that may provide efficient production of the component. The forward facing surface 35 of the nut 30 faces a flange 44 of the post 40 when operably assembled in a connector 100, so as to allow the nut to rotate with respect to the other component elements, such as the post 40 and the connector body 50, of the connector 100.

Referring still to FIG. 1, the connector 100 may include a post 40. The post 40 may include a first forward end 41 and an opposing second rearward end 42. Furthermore, the post 40 may include a flange 44, such as an externally extending annular protrusion, located at the first end 41 of the post 40. The flange 44 includes a rearward facing surface 45 that faces the forward facing surface 35 of the nut 30, when operably assembled in a coaxial cable connector 100, so as to allow the nut to rotate with respect to the other component elements, such as the post 40 and the connector body 50, of the connector 100. The rearward facing surface 45 of flange 44 may be a tapered surface facing the second rearward end 42 of the post 40. Further still, an embodiment of the post 40 may include a surface feature 47 such as a lip or protrusion that may engage a portion of a connector body 50 to secure axial movement of the post 40 relative to the connector body 50. However, the post need not include such a surface feature 47, and the coaxial cable connector 100 may rely on press-fitting and friction-fitting forces and/or other component structures having features and geometries to help retain the post 40 in secure location both axially and rotationally relative to the connector body 50. The location proximate or near where the connector body is secured relative to the post 40 may include surface features 43, such as ridges, grooves, protrusions, or knurling, which may enhance the secure attachment and locating of the post 40 with respect to the connector body 50. Moreover, the portion of the post 40 that contacts embodiments of a grounding member 98 may be of a different diameter than a portion of the nut 30 that contacts the connector body 50. Such diameter variance may facilitate assembly processes. For instance, various components having larger or smaller diameters can be readily press-fit or otherwise secured into connection with each other. Additionally, the post 40 may include a mating edge 46, which may be configured to make physical and electrical contact with a corresponding mating edge 26 of the interface port 20. The post 40 should be formed such that portions of a prepared coaxial cable 10 including the dielectric 16 and center conductor 18 may pass axially into the second end 42 and/or through a portion of the tube-like body of the post 40.

Moreover, the post 40 should be dimensioned, or otherwise sized, such that the post 40 may be inserted into an end of the prepared coaxial cable 10, around the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 should be conductive and may be formed of metals or may be formed of other conductive materials that would facilitate a rigidly formed post body. In addition, the post may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, combinations thereof, or other fabrication methods that may provide efficient production of the component.

The coaxial cable connector 100 may include a connector body 50. The connector body 50 may comprise a first end 51 and opposing second end 52. Moreover, the connector body may include a post mounting portion 57 proximate or otherwise near the first end 51 of the body 50, the post mounting portion 57 configured to securely locate the body 50 relative to a portion of the outer surface of post 40, so that the connector body 50 is axially secured with respect to the post 40, in a manner that prevents the two components from moving with respect to each other in a direction parallel to the axis of the connector 100. The internal surface of the post mounting portion 57 may include an engagement feature 54 that facilitates the secure location of the grounding member 98 with respect to the connector body 50 and/or the post 40, by physically engaging the grounding member 98 when assembled within the connector 100. The engagement feature 54 may simply be an annular detent or ridge having a different diameter than the rest of the post mounting portion 57. However other features such as grooves, ridges, protrusions, slots, holes, keyways, bumps, nubs, dimples, crests, rims, or other like structural features may be included to facilitate or possibly assist the positional retention of embodiments of the electrical grounding member 98 with respect to the connector body 50. Nevertheless, embodiments of the grounding member 98 may also reside in a secure position with respect to the connector body 50 simply through press-fitting and friction-fitting forces engendered by corresponding tolerances, when the various coaxial cable connector 100 components are operably assembled, or otherwise physically aligned and attached together. Various exemplary grounding members 98 are illustrated and described in U.S. Pat. No. 8,287,320, the disclosure of which is incorporated herein by reference. In addition, the connector body 50 may include an outer annular recess 58 located proximate or near the first end 51 of the connector body 50. Furthermore, the connector body 50 may include a semi-rigid, yet compliant outer surface 55, wherein an inner surface opposing the outer surface 55 may be configured to form an annular seal when the second end 52 is deformably compressed against a received coaxial cable 10 by operation of a fastener member 60. The connector body 50 may include an external annular detent 53 located proximate or close to the second end 52 of the connector body 50. Further still, the connector body 50 may include internal surface features 59, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIG. 1, the coaxial cable connector 100 may include a fastener member 60. The fastener member 60 may have a first end 61 and opposing second end 62. In addition, the fastener member 60 may include an internal annular protrusion 63 located proximate the first end 61 of the fastener member 60 and configured to mate and achieve purchase with the annular detent 53 on the outer surface 55 of connector body 50. Moreover, the fastener member 60 may comprise a central passageway 65 defined between the first end 61 and second end 62 and extending axially through the fastener member 60. The central passageway 65 may comprise a ramped surface 66 which may be positioned between a first opening or inner bore 67 having a first diameter positioned proximate with the first end 61 of the fastener member 60 and a second opening or inner bore 68 having a second diameter positioned proximate with the second end 62 of the fastener member 60. The ramped surface 66 may act to deformably compress the outer surface 55 of a connector body 50 when the fastener member 60 is operated to secure a coaxial cable 10. For example, the narrowing geometry will compress squeeze against the cable, when the fastener member is compressed into a tight and secured position on the connector body. Additionally, the fastener member 60 may comprise an exterior surface feature 69 positioned proximate with or close to the second end 62 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides substantially proximate significantly close to the nut 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

The manner in which the coaxial cable connector 100 may be fastened to a received coaxial cable 10 may also be similar to the way a cable is fastened to a common CMP-type connector having an insertable compression sleeve that is pushed into the connector body 50 to squeeze against and secure the cable 10. The coaxial cable connector 100 includes an outer connector body 50 having a first end 51 and a second end 52. The body 50 at least partially surrounds a tubular inner post 40. The tubular inner post 40 has a first end 41 including a flange 44 and a second end 42 configured to mate with a coaxial cable 10 and contact a portion of the outer conductive grounding shield or sheath 14 of the cable 10. The connector body 50 is secured relative to a portion of the tubular post 40 proximate or close to the first end 41 of the tubular post 40 and cooperates, or otherwise is functionally located in a radially spaced relationship with the inner post 40 to define an annular chamber with a rear opening. A tubular locking compression member may protrude axially into the annular chamber through its rear opening. The tubular locking compression member may be slidably coupled or otherwise movably affixed to the connector body 50 to compress into the connector body and retain the cable 10 and may be displaceable or movable axially or in the general direction of the axis of the connector 100 between a first open position (accommodating insertion of the tubular inner post 40 into a prepared cable 10 end to contact the grounding shield 14), and a second clamped position compressibly fixing the cable 10 within the chamber of the connector 100, because the compression sleeve is squeezed into retraining contact with the cable 10 within the connector body 50.

Figures 2A, 2B, 2C:
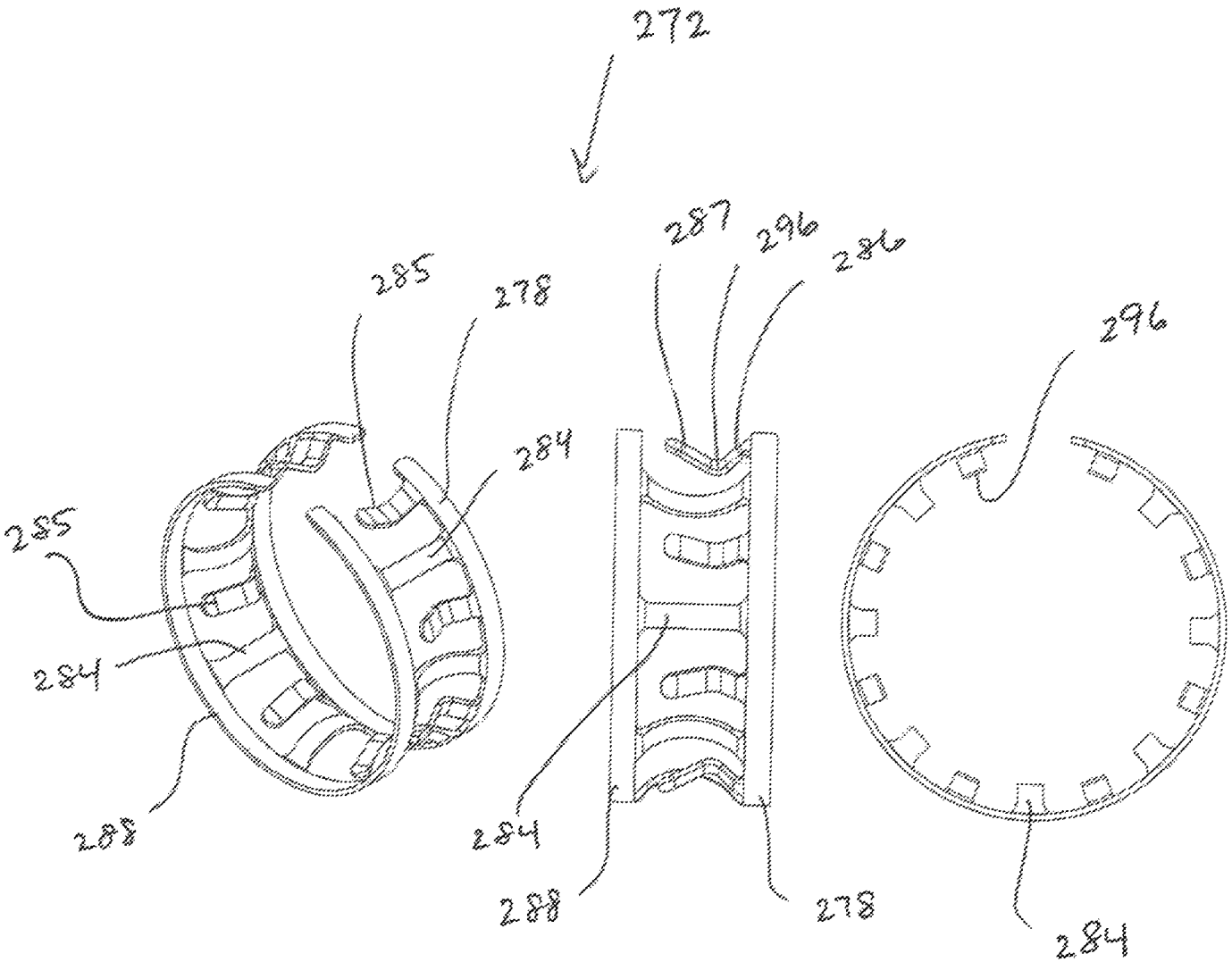
FIG. 2A is a perspective view of an exemplary conductive insert in accordance with various aspects of the disclosure.
FIG. 2B is a side view of the exemplary conductive insert of FIG. 2A.
FIG. 2C is an end view of the exemplary conductive insert of FIG. 2A.

Referring to FIGS. 2A-2C, an exemplary conductive insert 272 in accordance with various aspects of the disclosure is illustrated. The conductive insert 272 includes a rearward split ring 278 and a forward split ring 288 connected to one another by a plurality of resilient curved fingers 284. The rearward and forward split rings 278, 288 are nearly annular, but their free ends are spaced apart so as to allow the split rings 278, 288 to be radially compressed for insertion of the conductive insert 272 into the forward end 31 of the nut 30. After the conductive insert 272 is inserted into the forward end 31 of the nut 30, the rearward and forward split rings 278, 288 are permitted to uncompress so as to secure the conductive insert 272 within the forward end 31 of the nut 30.

Figure 2D:
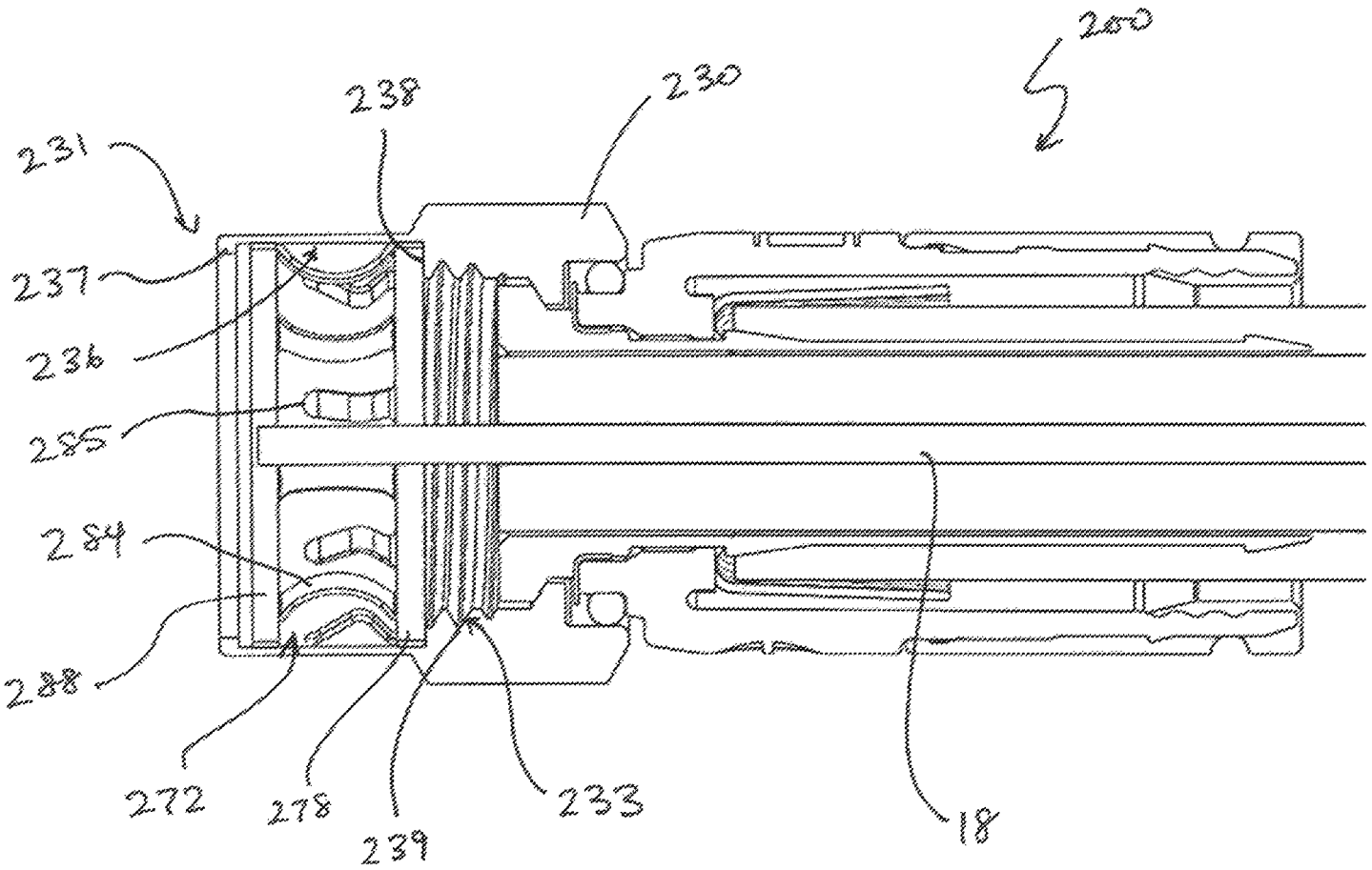
FIG. 2D is a side cross-sectional view of the exemplary conductive insert of FIG. 2A assembled on an exemplary connector.
Figure 2F:
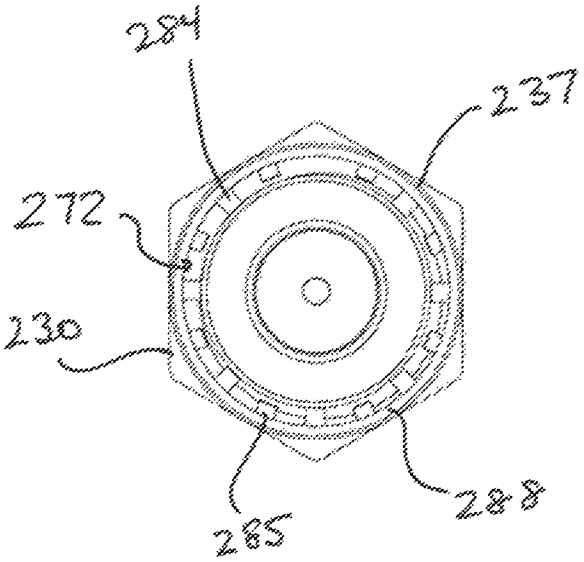
FIG. 2F is an end view of the exemplary conductive insert and exemplary connector of FIG. 2D.
Figure 2E:
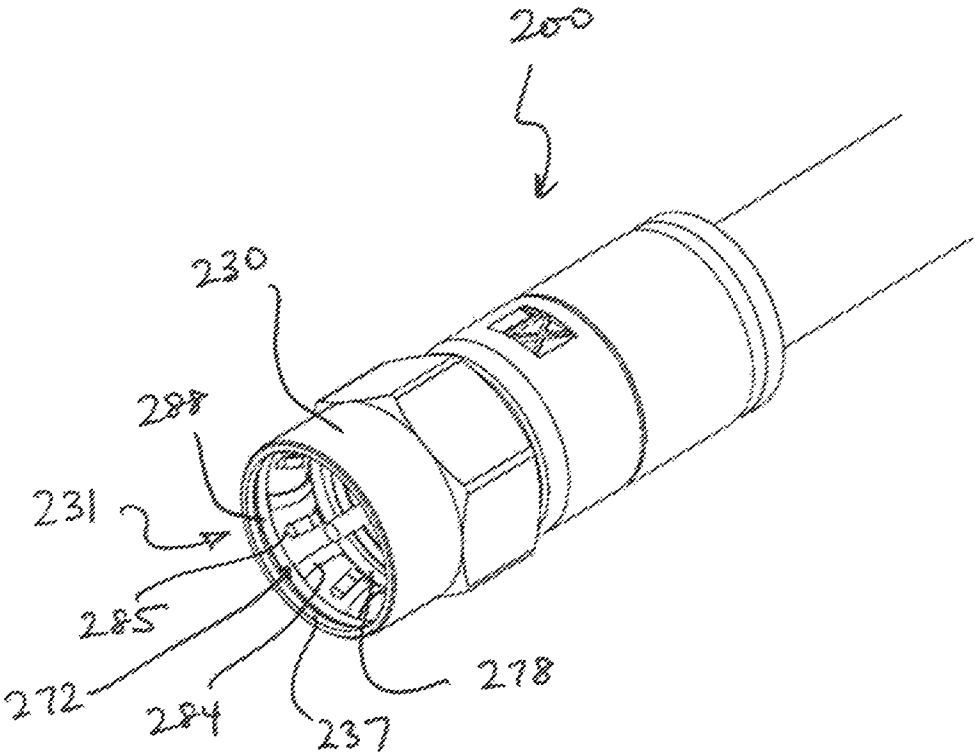
FIG. 2E is a perspective view of the exemplary conductive insert and exemplary connector of FIG. 2D.
Figure 2G:
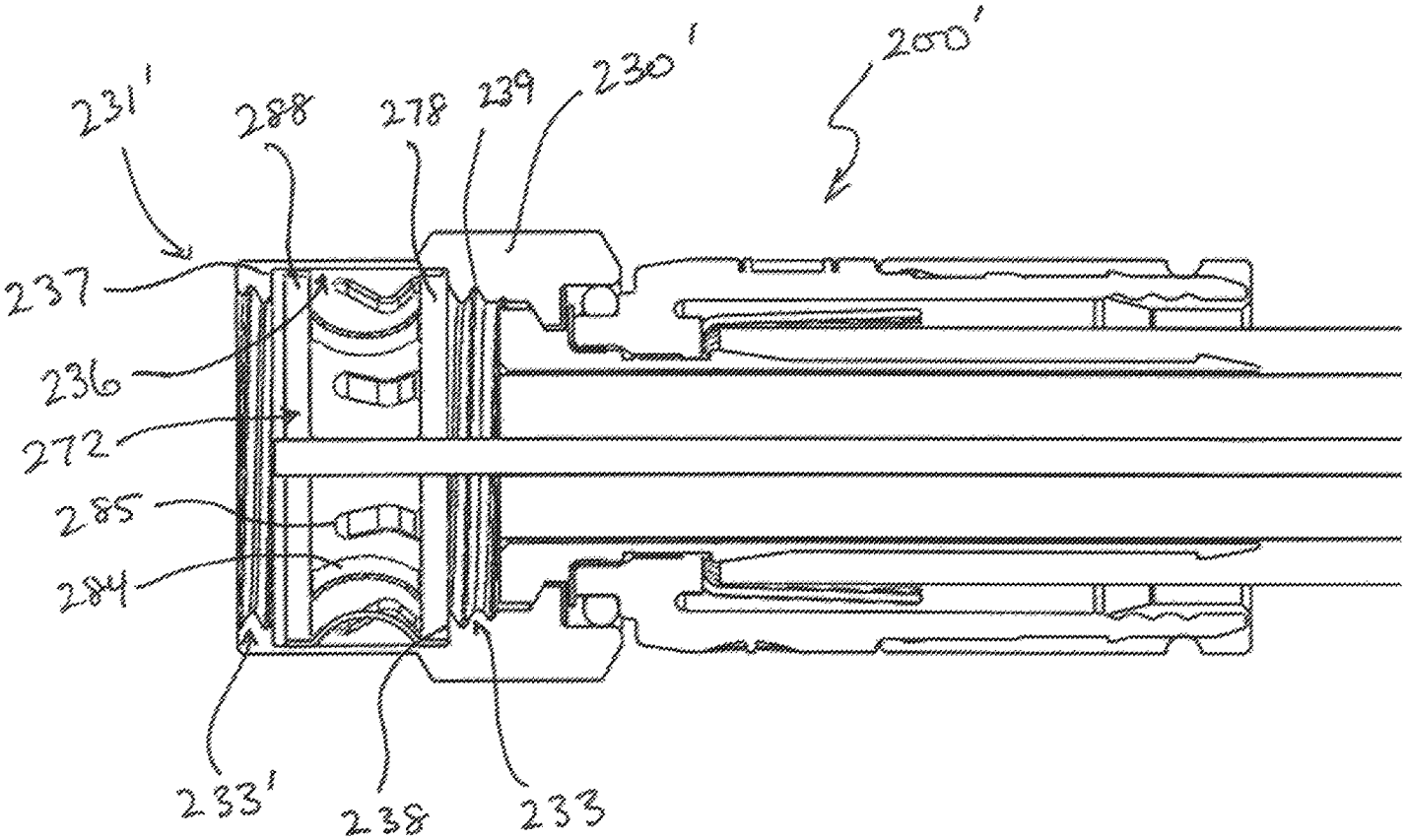
FIG. 2G is a side cross-sectional view of the exemplary conductive insert of FIG. 2A assembled on another exemplary connector.

In some aspects, as shown in FIGS. 2D-2F, the conductive insert 272 may be secured to a forward end 231 of a nut 230 of a connector 200 by an annular recess 236 at the interior surface of the nut 230. The annular recess 236 is delimited by a radial inward lip 237 at the forward end 231 of the nut and a forward-facing shoulder 238 at a forward end of the threaded region 233 of the nut 230. As illustrated, the annular recess 236 includes an axial length sized to receive both the rearward and forward split rings 278, 288 of the conductive insert 272 such that the conductive insert 272 is restricted from moving axially relative to the nut 230. However, in some aspects, the annular recess 236 may be configured to receive only one of the rearward and forward split rings 278, 288 such that the conductive insert 272 is restricted from moving axially relative to the nut 230. Although neither the conductive insert 272 nor the nut 230 includes a structure configured to restrict rotation of the nut 230 relative to the conductive insert 272, the outward biasing force of the rearward and forward split rings 278, 288 held in a state of radial compression by the nut 230 may inhibit relative rotation between the nut 230 and the conductive insert 272. In some embodiments, as shown in FIG. 2G, a connector 200' may include a nut 230' having a second threaded portion 233' at the forward end 231' of the nut 230'.

Referring again to FIGS. 2A-2C, the conductive insert 272 further includes a plurality of resilient cantilevered fingers 285 that are connected to and extend forwardly from the rearward split ring 278 in a cantilevered manner. Each of the cantilevered fingers 285 includes a first portion 286 that extends forwardly and radially inward from the rearward split ring 278 to a radially innermost portion 296 and a second portion 287 that extends forwardly and radially outward from the radially innermost portion 296.

It should be appreciated that in some aspects of the invention, the plurality of cantilevered fingers 285 can be connected to and extend rearward from the forward split ring 288 instead of the rearward split ring 278. In other aspects, some of the plurality of cantilevered fingers 285 can be connected to and extend forwardly from the rearward split ring 278 and some of the plurality of cantilevered fingers 285 can be connected to and extend rearward from the forward split ring 288.

In some aspects, the radially innermost portion 296 may be nearer to the rearward split ring 278, in as shown FIGS. 2A-2C, nearer to the forward split ring 288 (not shown), or at different axial locations relative to the rearward and forward split rings 278, 288, with some being nearer to the rearward split ring 278 and some being nearer to the forward split ring 288 (not shown).

It should be appreciated that the curved fingers 284 and the cantilevered fingers 285 extend radially inward beyond the valleys 239 of the threads of the internal threading 233 of the nut 230. Thus, when coupled with the threaded exterior surface 23 of the coaxial cable interface port 20, the curved fingers 284 and the cantilevered fingers 285 contact the threads of the threaded exterior surface 23 of the interface port 20 and are urged radially outward from their rest position. Thus, the radial inward bias of the curved fingers 284 and the cantilevered fingers 285 to return to their rest position promotes redundant contact, higher retention forces, and continuous grounding from the interface port 20 through to the post 40, even when the nut 230 is loosely connected (i.e., not fully tightened) to the interface port 20. It should also be appreciated that when the curved fingers 284 are urged radially outward, the rearward and forward split rings 278, 288 may be urged away from one another in the axial direction up to the limits imposed by the radial inward lip 237 at the forward end 231 of the nut and the forward-facing shoulder 238 at the forward end of the threaded region 233 of the nut 230.

Figures 3A, 3B, 3C:
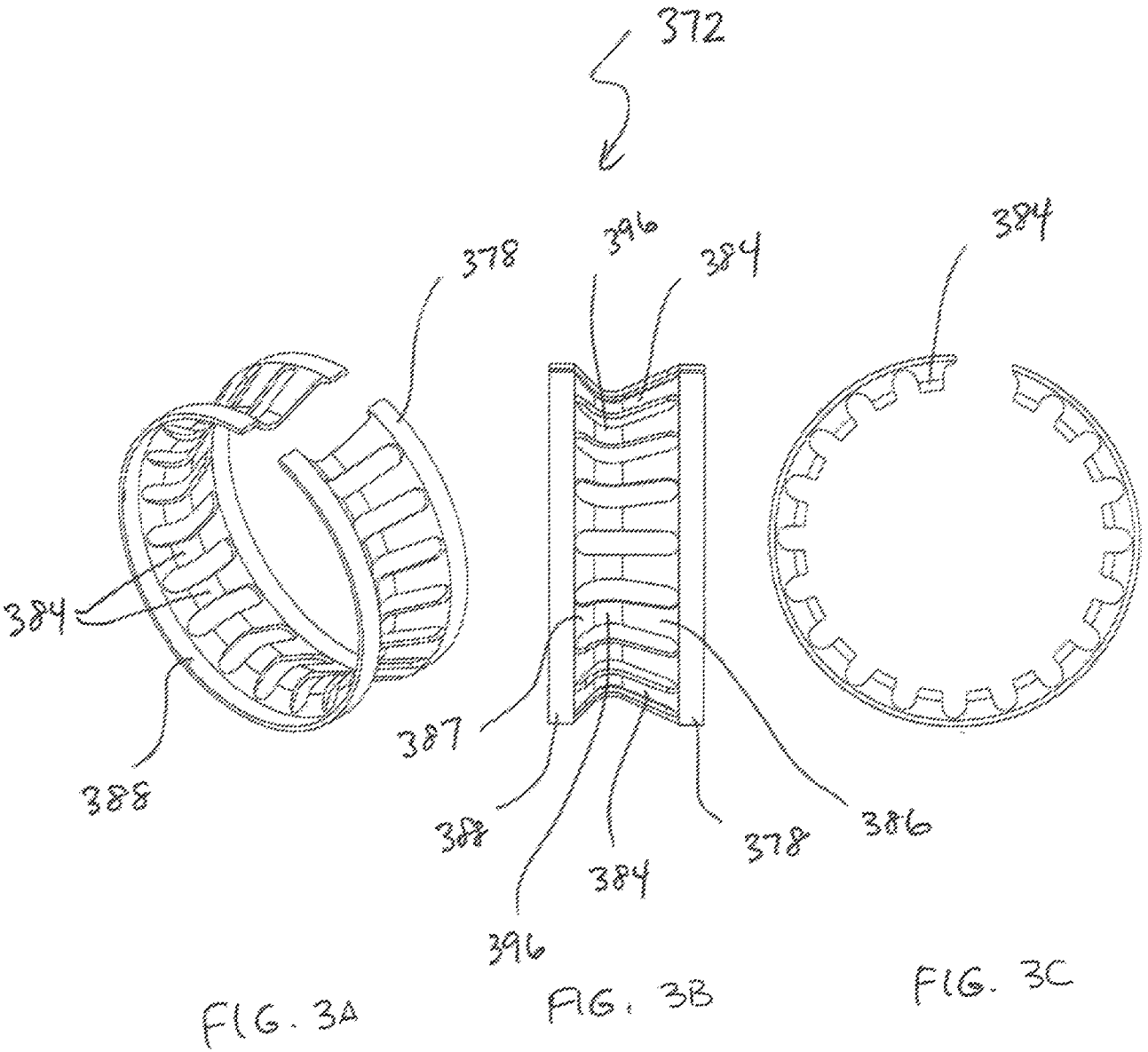
FIG. 3A is a perspective view of another exemplary conductive insert in accordance with various aspects of the disclosure.
FIG. 3B is a side view of the exemplary conductive insert of FIG. 3A.
FIG. 3C is an end view of the exemplary conductive insert of FIG. 3A.

Referring now to FIGS. 3A-3C, an exemplary conductive insert 372 in accordance with various aspects of the disclosure is illustrated. The conductive insert 372 includes a rearward split ring 378 and a forward split ring 388 connected to one another by a plurality of resilient fingers 384. The rearward and forward split rings 378, 388 are nearly annular, but their free ends are spaced apart so as to allow the split rings 378, 388 to be radially compressed for insertion of the conductive insert 372 into the forward end 31 of the nut 30. After the conductive insert 372 is inserted into the forward end 31 of the nut 30, the rearward and forward split rings 378, 388 are permitted to uncompress so as to secure the conductive insert 372 within the forward end 31 of the nut 30. In some aspects, the conductive insert 372 may be secured to the forward end 31 of the nut 30 by a recessed portion (as shown in FIGS. 2D-2F) at the interior surface of the nut 30 configured to receive at least one of the rearward and forward split rings 378, 388 such that the conductive insert 372 is restricted from moving axially relative to the nut 30 while permitting rotation of the nut 30 relative to the conductive insert 372.

Figures 4A, 4B, 4C:
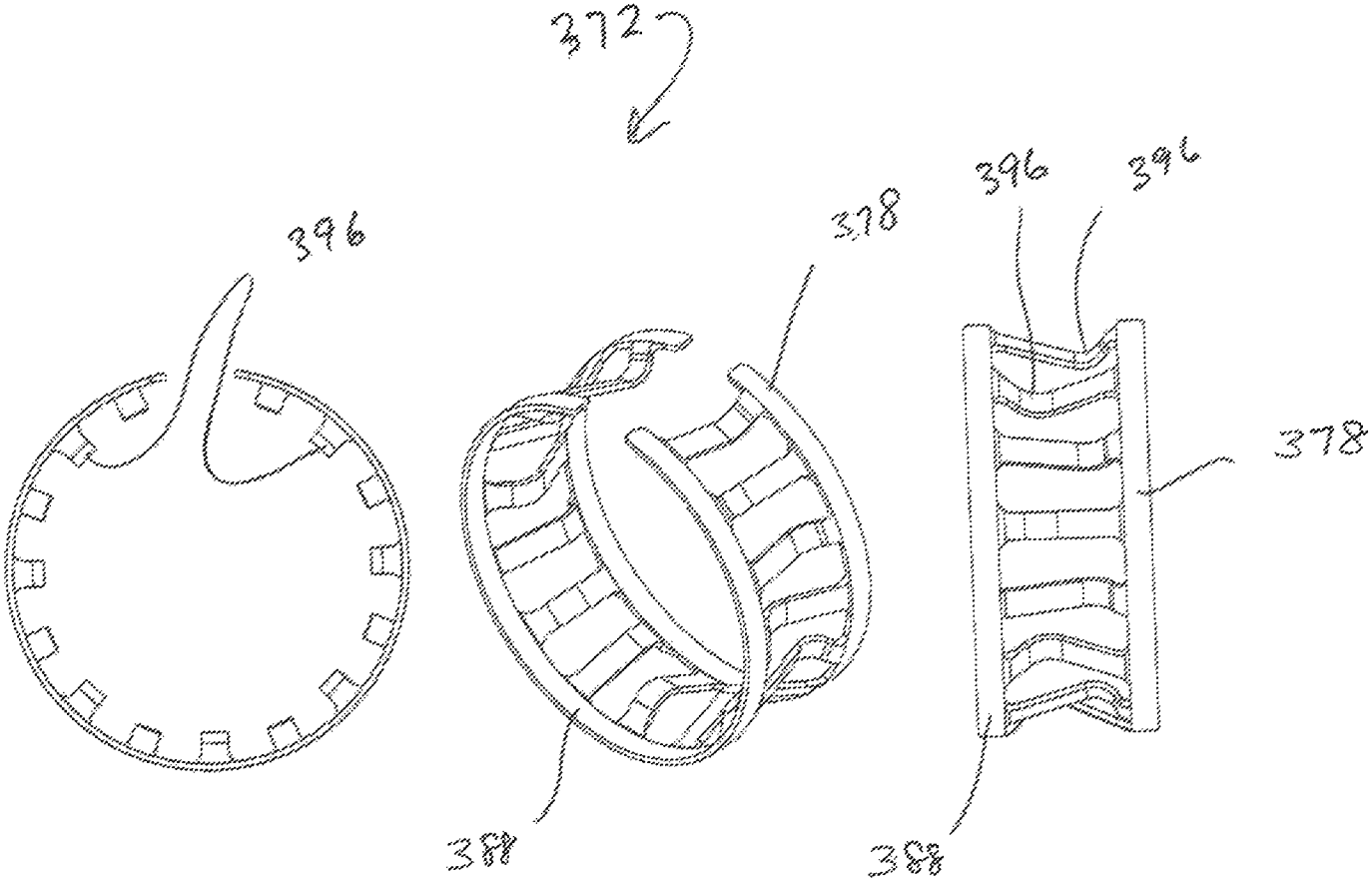
FIG. 4A is an end cross-sectional view of an exemplary conductive insert in accordance with various aspects of the disclosure.
FIG. 4B is a perspective view of the exemplary conductive insert of FIG. 4A.
FIG. 4C is a side view of the exemplary conductive insert of FIG. 4A.

Each of the fingers 384 includes a first portion 386 that extends forwardly and radially inward from the rearward split ring 378 to a radially innermost portion 396 and a second portion 387 that extends forwardly and radially outward from the radially innermost portion 396 to the forward split ring 388. As illustrated in FIGS. 3A-3C, the radially innermost portion 396 may be nearer to the forward split ring 388, which permits the radially innermost portion 396 to contact the interface port 20 sooner than if the radially innermost portion 396 was disposed more rearward. In some aspects of the invention, the radially innermost portion 396 may be nearer to the rearward split ring 378 (not shown) or, as illustrated in FIGS. 4A-4C, at different axial locations relative to the rearward and forward split rings 378, 388, with some being nearer to the rearward split ring 378 and some being nearer to the forward split ring 388.

It should be appreciated that the fingers 384 extend radially inward beyond threads of the internal threading 33 of the nut 30. Thus, when coupled with the threaded exterior surface 23 of the coaxial cable interface port 20, the fingers 384 promote redundant contact, higher retention forces, and continuous grounding from the interface port 20 through to the post 40, even when the nut 30 is loosely connected (i.e., not fully tightened) to the interface port 20.

Figures 5A, 5B, 5C:
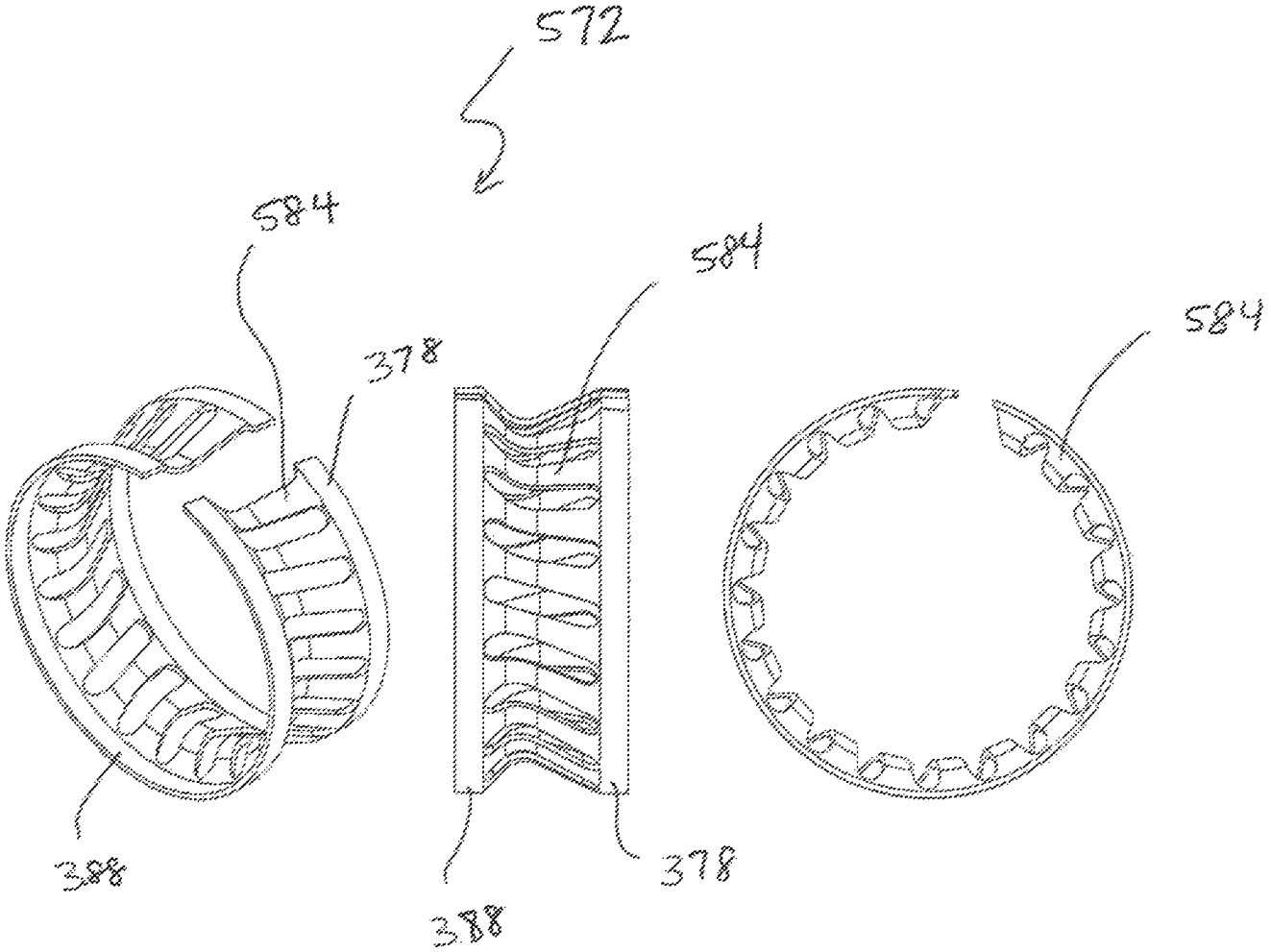
FIG. 5A is a perspective view of an exemplary conductive insert in accordance with various aspects of the disclosure.
FIG. 5B is a side view of the exemplary conductive insert of FIG. 5A.
FIG. 5C is an end view of the exemplary conductive insert of FIG. 5A.

With reference to FIGS. 5A-5C, an exemplary conductive insert 572 in accordance with various aspects of the disclosure is illustrated. The conductive insert 572 is substantially the same as the conductive insert 372 described above, except that the fingers 584 extend helically between the rearward annular ring 378 and the forward annular ring 388 rather than axially.

Referring now to FIGS. 6A-6F, an exemplary conductive insert 672 in accordance with various aspects of the disclosure is illustrated. The conductive insert 672 includes a rearward split ring 678 and a forward split ring 688 connected to one another by a plurality of curved fingers 684. The rearward and forward split rings 678, 688 are nearly annular, but their free ends are spaced apart so as to allow the split rings 678, 688 to be radially compressed for insertion of the conductive insert 672 into the forward end 31 of the nut 30. After the conductive insert 672 is inserted into the forward end 31 of the nut 30, the rearward and forward split rings 678, 688 are permitted to uncompress so as to secure the conductive insert 672 within the forward end 31 of the nut 30.

Figure 6C:
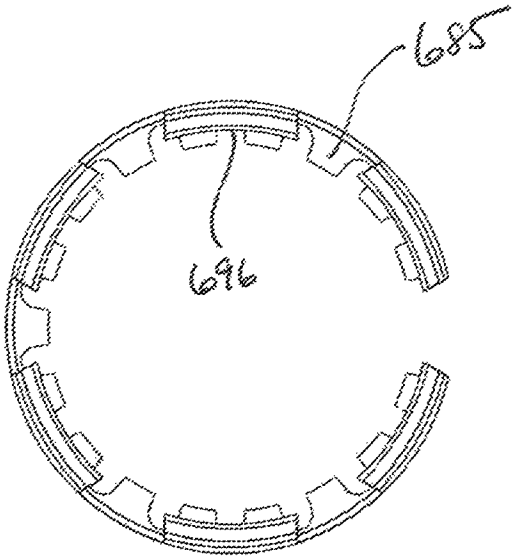
FIG. 6C is an end view of the exemplary conductive insert of FIG. 6A.
Figure 6B:
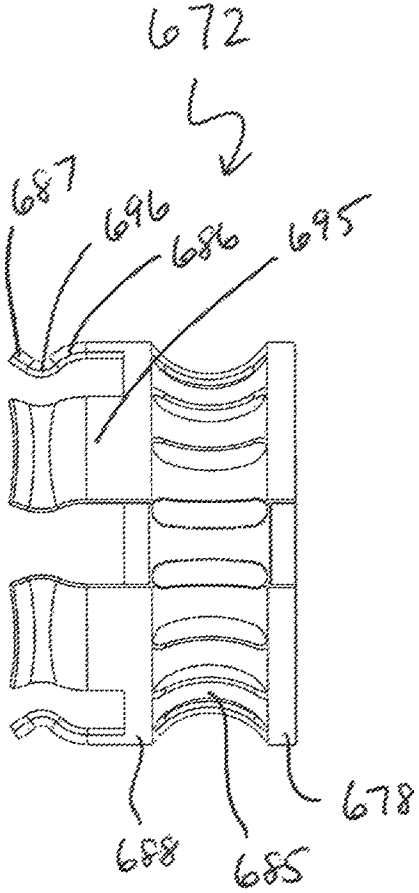
FIG. 6B is a side view of the exemplary conductive insert of FIG. 6A.
Figure 6A:
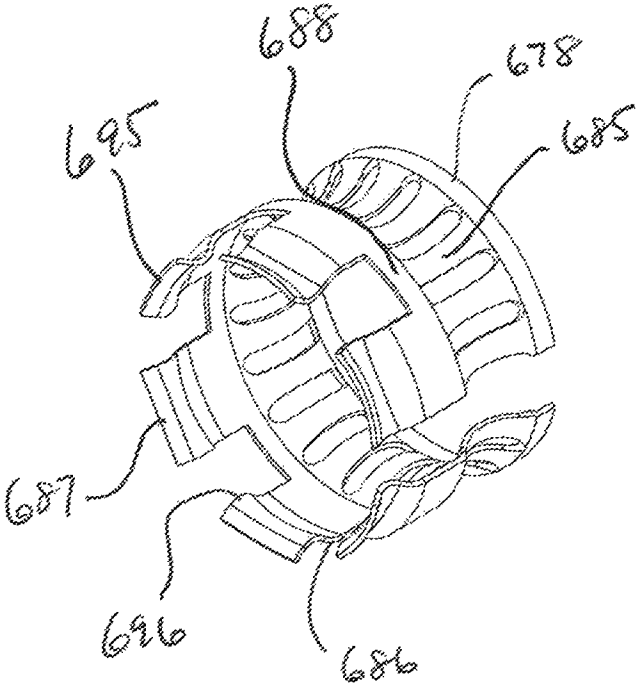
FIG. 6A is a perspective view of an exemplary conductive insert in accordance with various aspects of the disclosure.
Figure 6D:
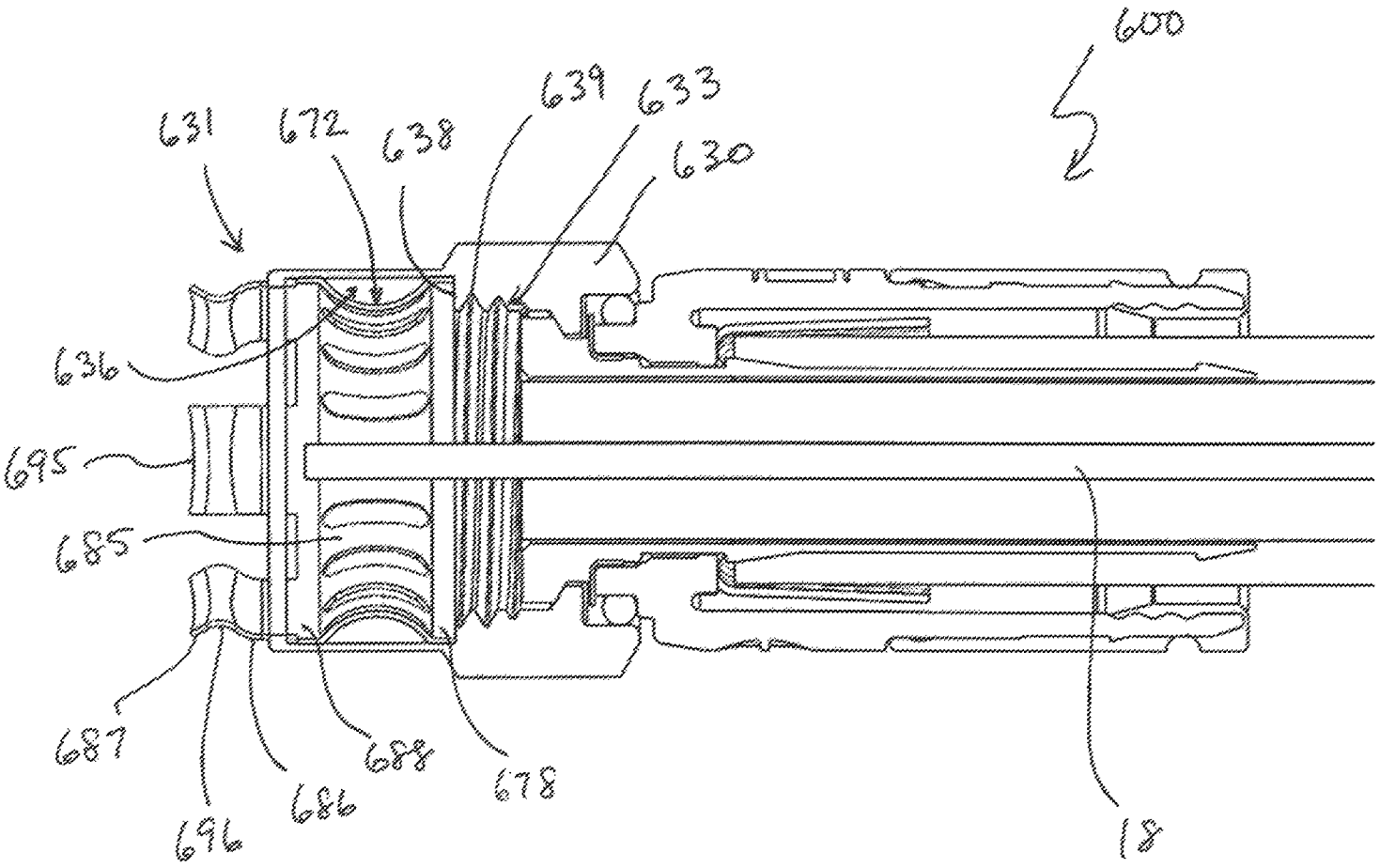
FIG. 6D is a side cross-sectional view of the exemplary conductive insert of FIG. 6A assembled on an exemplary connector.
Figure 6F:
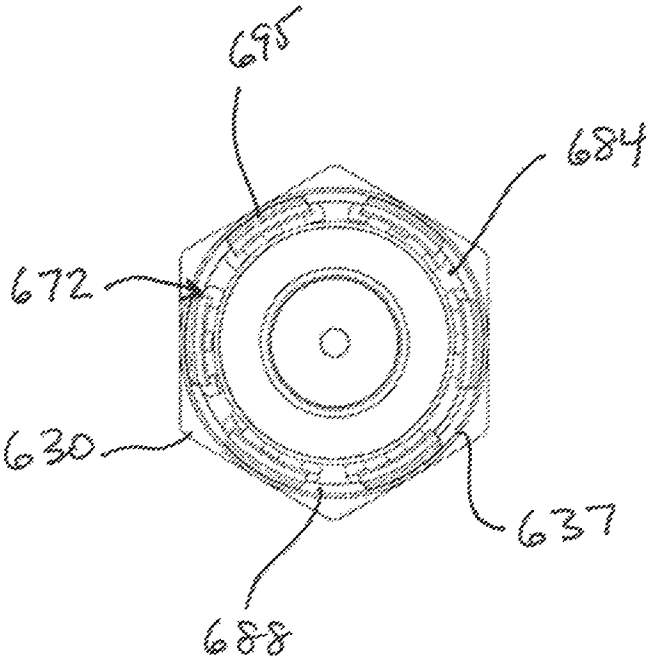
FIG. 6F is an end view of the exemplary conductive insert and exemplary connector of FIG. 6D.
Figure 6E:
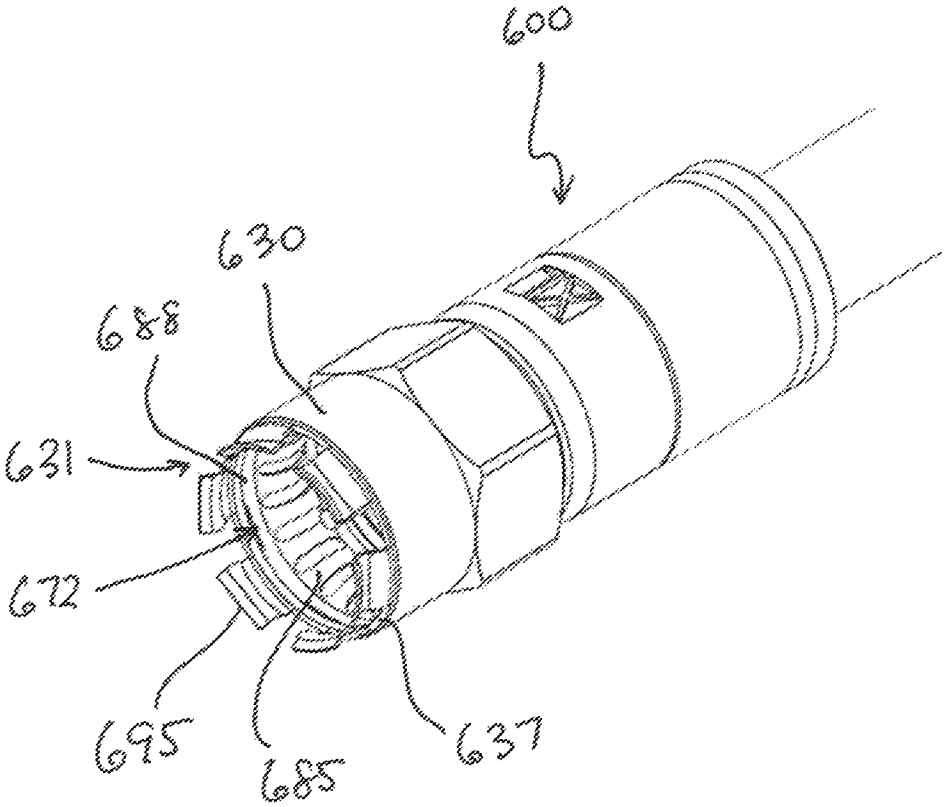
FIG. 6E is a perspective view of the exemplary conductive insert and exemplary connector of FIG. 6D.

In some aspects, as shown in FIGS. 6D-6F, the conductive insert 672 may be secured to a forward end 631 of a nut 630 of a connector 600 by an annular recess 636 at the interior surface of the nut 630. The annular recess 636 is delimited by a radial inward lip 637 at the forward end 631 of the nut and a forward-facing shoulder 638 at a forward end of the threaded region 633 of the nut 630. As illustrated, the annular recess 636 includes an axial length sized to receive both the rearward and forward split rings 678, 688 of the conductive insert 672 such that the conductive insert 672 is restricted from moving axially relative to the nut 630. However, in some aspects, the annular recess 636 may be configured to receive only one of the rearward and forward split rings 678, 688 such that the conductive insert 672 is restricted from moving axially relative to the nut 630. Although neither the conductive insert 672 nor the nut 630 includes a structure configured to restrict rotation of the nut 630 relative to the conductive insert 672, the outward biasing force of the rearward and forward split rings 678, 688 held in a state of radial compression by the nut 630 may inhibit relative rotation between the nut 630 and the conductive insert 672.

The conductive insert 672 further includes a plurality of grounding fingers 695 that extend forwardly from the forward ring 688. Each of the grounding fingers 695 includes a first portion 686 that extends forwardly and radially inward from the forward split ring 688 to a radially innermost portion 696 and a second portion 687 that extends forwardly and radially outward from the radially innermost portion 696. Thus, the radially innermost portion 696 of each of the grounding fingers 695 is forward of the forward end 31 and the internal threading 633 of the nut 630. It should be appreciated that the radial inward lip 637 includes one or more lip portion that are spaced apart circumferentially about the forward end 631 of the nut 630 such that each lip portion is disposed between a pair of adjacent grounding fingers 695.

As a result, the grounding fingers 695 can make contact with the interface port 20 before the center conductor 18 in order to create a ground from the interface port 20 through to the post 40 and thus limit burst that would otherwise occur upon insertion of the center conductor 18 into the interface port 20 in the absence of a ground.

It should be appreciated that the curved fingers 684 and the grounding fingers 695 extend radially inward beyond the valleys 639 of the threads of the internal threading 633 of the nut 630. Thus, when coupled with the threaded exterior surface 23 of the coaxial cable interface port 20, the curved fingers 684 and the grounding fingers 695 contact the threads of the threaded exterior surface 23 of the interface port 20 and are urged radially outward from their rest position. Thus, the radial inward bias of the curved fingers 684 and the grounding fingers 695 to return to their rest position promotes redundant contact, higher retention forces, and continuous grounding from the interface port 20 through to the post 40, even when the nut 630 is loosely connected (i.e., not fully tightened) to the interface port 20. It should also be appreciated that when the curved fingers 684 are urged radially outward, the rearward and forward split rings 678, 688 may be urged away from one another in the axial direction up to the limits imposed by the radial inward lip 637 at the forward end 631 of the nut and the forward-facing shoulder 638 at the forward end of the threaded region 633 of the nut 630.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A coaxial cable connector comprising:

a body configured to engage a coaxial cable having a conductive electrical grounding property;

a post configured to engage the body and the coaxial cable when the connector is installed on the coaxial cable;

a nut configured to engage an interface port with a retention force;

a conductive insert;

wherein the nut includes an inner surface configured to include a threaded portion and an annular groove between the threaded portion and a forward end of the nut;

wherein the conducive insert includes a first portion configured to be received in the annular groove;

wherein the first portion of the conductive insert is configured to include curved biasing members that are configured to extend radially inward from the annular groove so as to increase the retention force between the nut and the interface port and provide an electrical ground connection between the interface port and the nut, even when the nut is in a loosely tightened position on the interface port; and wherein the conductive insert is configured to include grounding members that are configured to extend from the first portion in the annular groove to beyond the forward end of the nut such that the grounding members are configured to make the electrical ground connection with the interface port before a center conductor of the coaxial cable makes an electrical connection with an internal contact of the interface port when the nut is coupled with the interface port.

2. The coaxial cable connector of claim 1, wherein the conductive insert is configured to include a first ring portion and a second ring portion;

wherein the curved biasing members are configured to extend from the first ring portion to the second ring portion;

wherein the first ring portion and the second ring portion are configured to be received in the annular groove; and wherein the grounding members are configured to extend from the first ring portion.

3. The coaxial cable connection or claim 1, wherein the nut is configured to include an annular lip adjacent the forward end; and wherein the annular groove is configured to extend from the annular lip to a forward facing surface of the threaded portion.

4. A coaxial cable connector comprising:

a body configured to engage a coaxial cable having a conductive electrical grounding property;

a post configured to engage the body and the coaxial cable when the connector is installed on the coaxial cable;

a nut configured to engage an interface port;

a conductive insert;

wherein the nut includes a inner surface configured to include a threaded portion and an annular groove between the threaded portion and a forward end of the nut;

wherein the conductive insert includes a first portion configured to be received in the annular grove; and wherein the conductive insert is configured to include grounding members that are configured to extend from the first portion in the annular groove to beyond the forward end of the nut such that the grounding members are configured to make the electrical ground connection with the interface port before a center conductor of the coaxial cable makes an electrical connection with an internal contact of the interface port when the nut is coupled with the interface port.

5. The coaxial cable connector of claim 4, wherein the threaded portion is configured to engage the interface port with a retention force.

6. The coaxial cable connector of claim 5, wherein the conductive insert includes curving biasing members configured to define an inner diameter smaller than an outer diameter of the interface port.

7. The coaxial cable connector of claim 6, wherein the curved biasing members are configured to curve radially from a first diameter at a rearward end portion to a second smaller diameter at a middle portion.

8. The coaxial cable connector of claim 7, wherein the curved biasing members are configured to curve radially outward from the middle portion to a front end portion.

9. The coaxial cable connector of claim 8, wherein the middle portion is configured to increase the retention force between the nut and the interface port.

10. The coaxial cable connector of claim 4, wherein the conductive insert is configured to include a first ring portion, a second ring portion, and curved biasing members configured to extend from the first ring portion to the second ring portion;

wherein the first ring portion and the second ring portion are configured to be received in the annular groove; and wherein the grounding members are configured to extend from the first ring portion.

11. The coaxial cable connection or claim 4, wherein the nut is configured to include an annular lip adjacent the forward end; and wherein the annular groove is configured to extend from the annular lip to a forward facing surface of the threaded portion.

12. A coaxial cable connector comprising:

a nut configured to engage an interface port;

a conductive insert;

wherein the nut includes an inner surface configured to include a threaded portion and an annular groove between the threaded portion and a forward end of the nut;

wherein the conductive insert includes a first portion configured to be received in the annular groove; and wherein the conductive insert is configured to include grounding members that are configured to extend from the first portion in the annular groove to beyond the forward end of the nut such that the grounding members are configured to make an electrical ground connection with the interface port before a center conductor of a coaxial cable terminated by the nut makes an electrical connection with an internal contact of the interface port when the nut is coupled with the interface port.

13. The coaxial cable connector of claim 12, wherein the threaded portion of the nut is configured to engage the interface port with a retention force.

14. The coaxial cable connector of claim 13, wherein the conductive insert includes a curved biasing member configured to define an inner diameter smaller than an outer diameter of the interface port.

15. The coaxial cable connector of claim 14, wherein the curving biasing member is configured to curve radially inward from a first diameter at a rearward end portion to a second smaller diameter at a middle portion.

16. The coaxial cable connector of claim 15, wherein the curved biased member is configured to curve radially outward from the middle portion to a front end portion.

17. The coaxial cable connector of claim 16, wherein the middle portion is configured to increase the retention force between the nut and the interface port.

18. The coaxial cable connector of claim 12, wherein the conductive insert is configured to include a first ring portion, a second ring portion, a curved biasing member configured to extend from the first ring portion to the second ring portion;

wherein the first ring portion and the second ring portion are configured to be received in the annular groove; and wherein the grounding members are configured to extend from the first ring portion.

19. The coaxial cable connection or claim 12, wherein the nut is configured to include an annular lip adjacent the forward end; and wherein the annular groove is configured to extend from the annular lip to a forward facing surface of the threaded portion.

20. The coaxial cable connector of claim 12, wherein the conductive insert is configured to include a first ring portion, a second ring portion, a curved biasing member configured to extend from the first ring portion to the second ring portion;

wherein the first ring portion and the second ring portion are configured to be received in the annular groove; and wherein the grounding members are configured to extend from the first ring portion.

21. The coaxial cable connection or claim 12, wherein the nut is configured to include an annular lip adjacent the forward end; and wherein the annular groove is configured to extend from the annular lip to a forward facing surface of the threaded portion.

22. A coaxial cable connector comprising:

a first portion configured to terminate a coaxial cable;

a nut configured to be rotatingly coupled to the first portion and to engage an interface port;

a conductive insert;

wherein the nut includes an inner surface configured to include a threaded portion and an annular groove between the threaded portion and a forward end of the nut;

wherein the conductive insert includes a first portion configured to be received in the annular groove; and wherein the conductive insert is configured to include grounding members that are configured to extend from the first portion in the annular groove to beyond the forward end of the nut such that the grounding members are configured to make the electrical ground connection with the interface port before a center conductor of a coaxial cable makes an electrical connection with an internal contact of the interface port when the nut is coupled with the interface port.

23. The coaxial cable connector of claim 22, wherein the threaded portion is configured to engage the interface port with a retention force.

24. The coaxial cable connector of claim 23, wherein the conductive insert includes a curved biasing member configured to define an inner diameter smaller than an outer diameter of the interface port.

25. The coaxial cable connector of claim 24, wherein the curved biasing member is configured to curve radially inward from a first diameter at a rearward end portion to a second smaller diameter at a middle portion.

26. The coaxial cable connector of claim 25, wherein the curved biasing member is configured to curve radially outward from the middle portion to a front end portion.

27. The coaxial cable connector of claim 26, wherein the middle portion is configured to increase the retention force between the nut and the interface port.

* * * * *